US007216749B2

(12) United States Patent
Droste

(10) Patent No.: US 7,216,749 B2
(45) Date of Patent: May 15, 2007

(54) CLUTCH FOR ROTARY POWER TOOL AND ROTARY POWER TOOL INCORPORATING SUCH CLUTCH

(75) Inventor: Manfred Droste, Limburg-Offheim (DE)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/825,838

(22) Filed: Apr. 16, 2004

(65) Prior Publication Data

US 2004/0216976 A1 Nov. 4, 2004

(30) Foreign Application Priority Data

Apr. 17, 2003 (GB) ..... 0309055.2
May 3, 2003 (GB) ..... 0310287.8
Nov. 6, 2003 (GB) ..... 0325879.5

(51) Int. Cl.
*B25D 16/00* (2006.01)
*B25D 17/08* (2006.01)

(52) U.S. Cl. ..... 192/56.61; 464/39

(58) Field of Classification Search ..... 192/56.1, 192/56.61; 464/39

See application file for complete search history.

(56) References Cited

U.S. PATENT DOCUMENTS 2,225,091 A * 12/1940 Wilhide ..... 173/93.6
2,291,407 A * 7/1942 Paul ..... 464/39
2,729,076 A * 1/1956 Thomson ..... 464/10
3,727,432 A 4/1973 Eaves et al.
3,889,491 A * 6/1975 Wanner et al. ..... 464/36
3,908,437 A 9/1975 Bachmann
3,937,038 A 2/1976 Saurwein
3,952,814 A 4/1976 Gelfand et al.
4,006,785 A 2/1977 Roll et al.
4,007,818 A 2/1977 Orwin
4,075,873 A 2/1978 Geisthoff
4,124,327 A 11/1978 Yoshida et al.
4,265,320 A 5/1981 Tanaka et al.
4,290,515 A 9/1981 Bogema et al.
4,365,962 A 12/1982 Regelsberger
4,383,454 A 5/1983 Calabrese
4,812,089 A 3/1989 Petrie (Continued)

FOREIGN PATENT DOCUMENTS

EP 05 523 28 A 1/1993
GB 2 322 675 A 9/1998

*Primary Examiner*—Saul Rodriguez
(74) *Attorney, Agent, or Firm*—Michael P. Leary; Charles E. Yocum; Adan Ayala

(57) ABSTRACT

An external surface of a spindle is formed with tapering grooves which become narrower in a direction towards the forward end of the spindle. A slider sleeve is provided with splines which also taper in a forward direction. In this way, the slider sleeve is prevented from rotating relative to the spindle, but can slide axially. A rearward end of the slider sleeve includes a recess containing an elastomeric O-ring. When the drive torque exceeds a predetermined threshold, inclined surfaces of the mutually engaging teeth on the spindle drive gear and slider sleeve slide over each other, as a result of which the drive gear slides forwardly along the slider sleeve against the action of a spring. The spindle drive gear can then rotate relative to the slider sleeve and the cooperating sets of teeth ratchet over each other, preventing spindle drive gear being from rotating the spindle.

34 Claims, 6 Drawing Sheets

U.S. PATENT DOCUMENTS 4,871,033 A 10/1989 Odoni et al.
4,919,221 A 4/1990 Pascale
4,967,888 A 11/1990 Lipparcher et al.
5,005,684 A 4/1991 Fujii
5,094,330 A 3/1992 Lee
5,373,905 A * 12/1994 Bleicher et al. ..... 173/109
5,499,828 A 3/1996 Salpaka et al.
5,588,496 A 12/1996 Elger
5,616,080 A 4/1997 Milescher
5,673,758 A 10/1997 Sasaki et al.
5,778,989 A 7/1998 Neumeier
5,842,527 A 12/1998 Arakawa et al.
5,857,913 A 1/1999 Fujimura et al.
5,947,210 A 9/1999 Sasaki et al.
5,947,214 A 9/1999 Tibbitts
6,305,481 B1 10/2001 Yamazaki et al.

* cited by examiner

CLUTCH FOR ROTARY POWER TOOL AND ROTARY POWER TOOL INCORPORATING SUCH CLUTCH

FIELD OF THE INVENTION

The present invention relates to a clutch for a rotary power tool, and relates particularly, but not exclusively, to an overload clutch for a handheld power hammer. The invention also relates to a handheld power hammer incorporating such a clutch.

BACKGROUND OF THE INVENTION

Rotary hammers are known which have a housing and a hollow cylindrical spindle mounted in the housing. The spindle allows insertion of the shank of a tool or bit, for example a drill bit or a chisel bit, into the front end thereof so that it is retained in the front end of the spindle with a degree of axial movement. The spindle may be a single cylindrical part or may be made of two or more cylindrical parts, which together form the hammer spindle. For example, a front part of the spindle may be formed as a separate tool holder body for retaining the tool or bit. Such hammers are generally provided with an impact mechanism which converts the rotational drive from an electric motor to a reciprocating drive causing a piston, which may be a hollow piston, to reciprocate within the spindle. The piston reciprocatingly drives a ram by means of a closed air cushion located between the piston and the ram. The impacts from the ram are then transmitted to the tool or bit of the hammer, optionally via a beatpiece.

Some hammers can be employed in combination impact and drilling mode or in a drilling only mode in which the spindle, or a forwardmost part of the spindle, and hence the bit inserted therein will be caused to rotate. In the combination impact and drilling mode the bit will be caused to rotate at the same time as the bit receives repeated impact. Such hammers generally also have a hammer only mode in which the spindle is locked against rotation.

Rotary hammers are known to have overload clutches in the drive train which transmits rotary drive from the motor to the spindle, or forwardmost part of the spindle. Such overload clutches are designed to transmit rotary drive when the transmitted drive torque is below a predetermined threshold and to slip when the transmitted drive torque exceeds the threshold. During rotary hammering or drilling, when working on materials of non-uniform hardness, for example aggregate or steel reinforced concrete, the bit can become stuck, which causes the torque transmitted via the rotary drive train to increase and causes the hammer housing to tend to rotate against the grip of the user. An overload clutch can slip and interrupt rotary drive to the bit at a torque threshold below that where a user may experience difficulty in controlling the hammer. Accordingly, the clutch must slip reliably at a predetermined torque throughout the lifetime of the hammer, even after sustained use of the hammer.

An overload clutch of this type is disclosed in EP 0552328, in which a pair of cooperating ratchet plates are urged into engagement with each other by a compression spring. When a predetermined threshold torque is exceeded, for example as a result of the drill bit becoming stuck in a workpiece, the ratchet plates can slip relative to each other against the action of the spring. However, known overload clutches of this type suffer from the drawback that at very high torque levels, the ratchet plates can be moved rapidly out of engagement with each other to the extremities of their permitted relative movement and then move rapidly back into engagement with each other, causing problems in controlling the tool.

Preferred embodiments of the present invention seek to overcome the above disadvantages of the prior art.

BRIEF SUMMARY OF THE INVENTION

According to an aspect of the present invention, there is provided a clutch for a rotary power tool having a housing, a spindle rotatably mounted within the housing, and a motor for causing rotation of said spindle about a first axis, the clutch comprising:

a first clutch member adapted to be mounted to said spindle and to rotate therewith and slide relative thereto in a direction substantially parallel to said first axis, said first clutch member having at least one first friction surface inclined in use relative to said first axis for engaging a respective corresponding second friction surface on said spindle as a result of movement of said first clutch member relative to the spindle;

first biasing means adapted to act between said spindle and said first clutch member for biasing said first clutch member towards a stop;

a second clutch member having a first condition in which said second clutch member engages said first clutch member and rotates therewith, and a second condition in which said second clutch member can move relative to said first clutch member; and second biasing means adapted to act between said first and second clutch members for urging said second clutch member towards said first condition. By providing a first clutch member having at least one first friction surface inclined relative to the first axis for engaging a respective corresponding second friction surface on the spindle, this provides the advantage of providing a reaction force, from the or each corresponding second friction surface on the spindle, which has a component resisting axial movement of the first clutch member relative to the spindle. This in turn reduces the tendency of the first clutch member to move axially too rapidly relative to the spindle.

In a preferred embodiment, said second clutch member is adapted to be mounted to said first clutch member and to slide relative thereto in a direction substantially parallel to said first axis, said first and second clutch members have cooperating engaging portions, and said second biasing means is adapted to urge said cooperating engaging portions into engagement with each other, such that when a torque applied between said first and second clutch members does not exceed a predetermined value, said cooperating engaging portions engage each other to prevent relative rotation between said first and second clutch members, and when said torque exceeds said predetermined value, axial movement of said second clutch member relative to said first clutch member against the action of said second biasing means occurs to disengage said cooperating engaging portions from each other, thereby permitting relative rotation between said first and second clutch members.

The first clutch member may be adapted to abut the second clutch member, and the cooperating engaging portions may comprise a plurality of teeth on said first and second clutch members.

The teeth may be adapted to engage each other by means of cooperating inclined surfaces.

The cooperating engaging portions may comprise at least one respective third friction surface on said first clutch member and at least one fourth friction surface on said second clutch member.

The first clutch member may be a drive gear adapted to be driven by means of the motor.

The first and/or second biasing means may comprise at least one respective compression spring.

The clutch may further comprise at least one resilient stop member adapted to engage said first clutch member at said stop.

This provides the advantage of minimising impact between the first clutch member and the stop.

Said first clutch member may further comprise a recess having an inclined surface for engaging at least one said resilient stop member.

This provides the advantage of bringing the first clutch member into more controlled engagement with the stop member.

The first clutch member may have a pair of said first friction surfaces, each said first friction surface inclined in use relative to said first axis for engaging a respective corresponding second friction surface on the spindle.

This provides the advantage of providing more effective braking of the first clutch member relative to the spindle for each direction of rotation of the spindle.

According to another aspect of the present invention, there is provided a clutch for a rotary power tool having a housing, a spindle rotatably mounted within the housing, and a motor for causing rotation of the spindle about a first axis, the clutch comprising:

a first clutch member adapted to be mounted to the spindle and to rotate therewith and slide relative thereto in a direction substantially parallel to said first axis;

first biasing means adapted to act between said spindle and said first clutch member for biasing said first clutch member towards a stop;

a second clutch member having a first condition in which said second clutch member engages said first clutch member and rotates therewith, and a second condition in which said second clutch member can move relative to said first clutch member;

second biasing means adapted to act between said first and second clutch members for urging said second clutch member towards said first condition; and at least one resilient stop member adapted to engage said first clutch member at said stop.

By providing at least one resilient stop member adapted to engage the first clutch member at the stop, this provides the advantage of minimising impact between the first clutch member and the stop, which in turn minimises the extent to which the first clutch member is brought back into engagement with the stop on the spindle too violently.

In a preferred embodiment, said second clutch member is adapted to be mounted to said first clutch member and to slide relative thereto in a direction substantially parallel to said first axis, said first and second clutch members have cooperating engaging portions, and said second biasing means is adapted to urge said cooperating engaging portions into engagement with each other, such that when a torque applied between said first and second clutch members does not exceed a predetermined value, said cooperating engaging portions engage each other to prevent relative rotation between said first and second clutch members, and when said torque exceeds said predetermined value, axial movement of said second clutch member relative to said first clutch member against the action of said second biasing means occurs to disengage said cooperating engaging portions from each other, thereby permitting relative rotation between said first and second clutch members.

Preferably, the first clutch member is adapted to abut the second clutch member, and the cooperating engaging portions comprise a plurality of teeth on said first and second clutch members.

The teeth may be adapted to engage each other by means of cooperating inclined surfaces.

The cooperating engaging portions may comprise at least one first friction surface on said first clutch member and a respective second friction surface on said second clutch member.

Said first clutch member may further comprise a recess having an inclined surface for engaging at least one said resilient stop member.

This provides the advantage of bringing the first clutch member into more controlled engagement with the stop member.

Said first clutch member may further comprise at least one third friction surface inclined in use relative to said first axis for engaging a respective corresponding fourth friction surface on said spindle.

By providing a first clutch member having at least one third friction surface inclined relative to the first axis for engaging a respective corresponding fourth friction surface on the spindle, this provides the advantage of providing a reaction force, from the or each corresponding fourth friction surface on the spindle, which has a component resisting axial movement of the first clutch member relative to the spindle. This in turn reduces the tendency of the first clutch member to move axially too rapidly relative to the spindle.

The first clutch member may have a pair of said third friction surfaces, each said third friction surface inclined in use relative to said first axis for engaging a respective corresponding fourth friction surface on the spindle.

This provides the advantage of providing more effective braking of the first clutch member relative to the spindle for each direction of rotation of the spindle.

The first clutch member may be a drive gear adapted to be driven by means of the motor.

The first and/or second biasing means may comprise at least one respective compression spring.

According to a further aspect of the present invention, there is provided a rotary power tool comprising:

a housing;

a spindle rotatably mounted within the housing;

a motor for causing rotation of said spindle about an axis; and a clutch as defined above mounted to said spindle.

Said cooperating engaging portions may comprise a tapered projection on one of said first and second clutch member and a tapered groove on the other of said first and second clutch members.

The tool may be a hammer.

BRIEF DESCRIPTION OF THE DRAWINGS

A preferred embodiment of the invention will now be described, by way of example only, and not in any limitative sense, with reference to the accompanying drawings, in which.

DETAILED DESCRIPTION OF THE INVENTION

Figure 1:
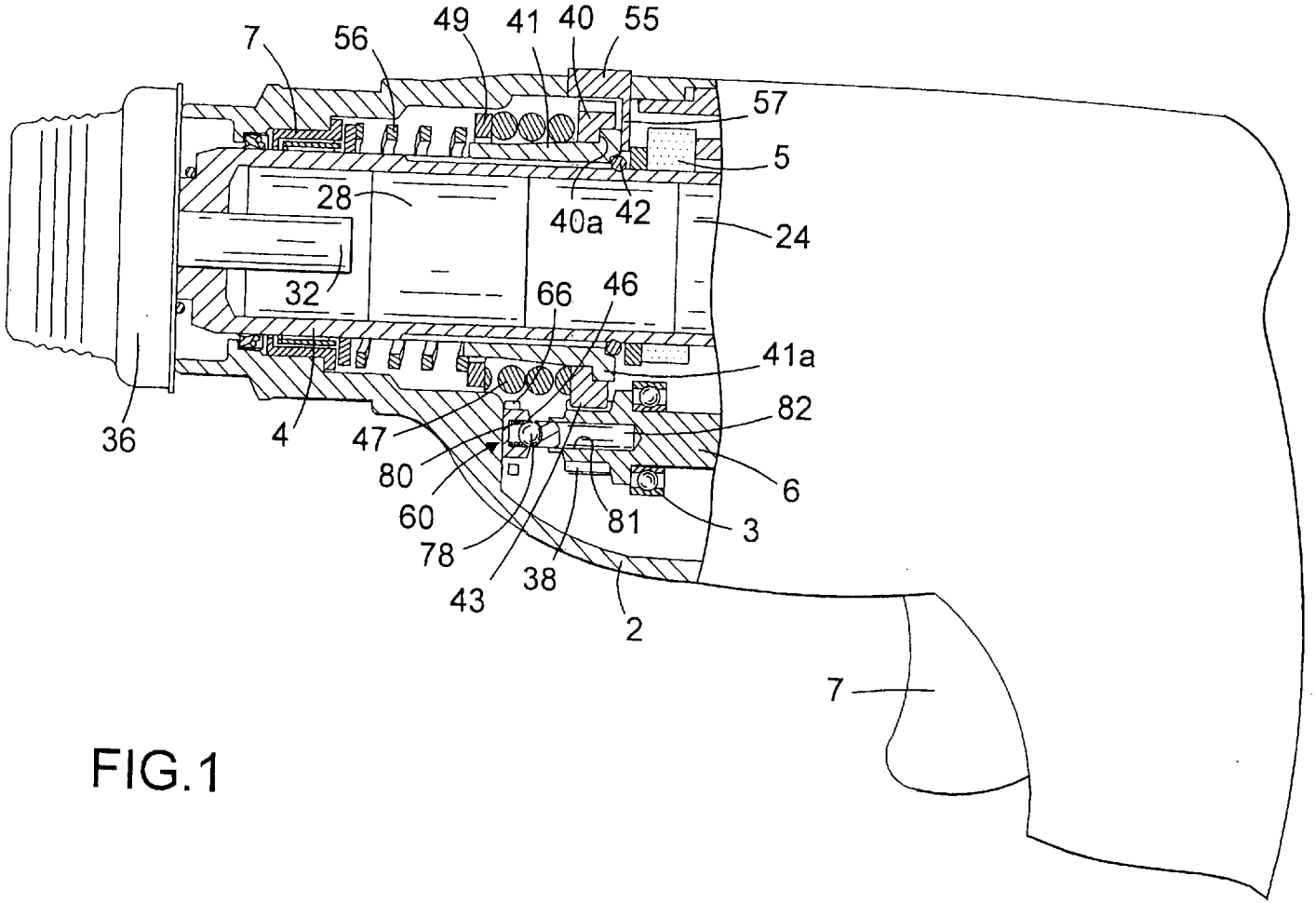
FIG. 1 is a partially cut-away side cross-sectional elevation view of a rotary hammer embodying the present invention.

Referring to FIG. 1, a rotary hammer has a forward portion shown in cross-section, and a rear portion incorporating a motor and pistol grip rear handle in a conventional manner. Alternatively, the handle may be of the D handle type. The handle portion incorporates a trigger switch 7 for actuating an electric motor which carries a pinion (not shown) at the forward end of its armature shaft. The pinion of the motor rotatingly drives an intermediate shaft 6 via a gear which is press fit onto the rearward end of the intermediate shaft 6. The intermediate shaft 6 is rotatably mounted in a housing 2 of the hammer via a first bearing (not shown) located at the rearward end of the intermediate shaft 6 and a forward bearing 3 located at the forward end of the intermediate shaft 6.

A wobble drive hammering mechanism, of a type which will be familiar to persons skilled in the art, is provided for reciprocatingly driving a piston 24. The piston 24 is slidably located within a hollow cylindrical spindle 4 and an O-ring seal (not shown) is mounted around the piston 24 so as to seal between the periphery of the piston 24 and the internal surface of the spindle 4. A ram 28 is slidably mounted within the spindle 4 and an O-ring seal (not shown) is mounted around the ram 28 so as to seal between the periphery of the ram 28 and the internal surface of the spindle 4. In this way, during normal operation of the hammer, a closed air cushion is formed between the forward face of the piston 24 and the rear face of the ram 28, which causes the ram to be reciprocatingly driven by the piston via the closed air cushion. During normal operation of the hammer, the ram 28 repeatedly impacts a beatpiece 32, which is reciprocatingly mounted within the spindle 4. The beatpiece 32 transfers impacts from the ram 28 to a tool or bit (not shown) mounted within a forward tool holder portion of the spindle 4 by means of a tool holder arrangement 36, of a type which will be familiar to persons skilled in the art. The tool or bit is releasably locked within the tool holder portion of the spindle 4 so as to be able to reciprocate within the tool holder portion of the spindle by a limited amount.

The spindle 4 is rotatably mounted in the hammer housing 2 by means of bearings 5, 7. Simultaneously with, or as an alternative to, the hammering action generated by the hammering mechanism described above, the spindle 4 can be rotatingly driven by the intermediate shaft 6 as described below. Thus, as well as reciprocating, the tool or bit is rotatingly driven because it is non-rotatably mounted within the spindle 4 by the tool holder arrangement 36.

An overload clutch mechanism includes a spindle drive gear 40 rotatably and axially slidably mounted on a slider sleeve 41, and the slider sleeve 41 is non-rotatably and axially slidably mounted on the spindle 4. The spindle drive gear 40 is formed on its periphery with a set of teeth 43. The intermediate shaft 6 is formed at its forward end with a pinion 38 and the teeth 43 of the spindle drive gear 40 may be brought into engagement with the pinion 38 in order to transmit rotary drive to the slider sleeve 41 and thereby to the spindle 4. The spindle drive gear 40 transmits rotary drive to the slider sleeve 41 via the overload clutch arrangement. The spindle drive gear 40 has a set of rearwardly facing teeth 40*a* formed on a rearward facing surface thereof, this set of teeth 40*a* being biased into engagement with a set of teeth formed on a forward facing surface 41*a* on an annular flange of the slider sleeve 41. The sets of teeth are biased into engagement with each other by a spring 47 mounted on the slider sleeve 41 to extend between a washer 49 axially fixedly mounted at the forward end of the slider sleeve 41, and a forward facing end surface of the spindle drive gear 40.

The slider sleeve 41 is axially biased by means of a spring 56 into a rearward position against an elastomeric O-ring 42 mounted in a recess 102 (FIGS. 4 and 5) formed in the external surface of the spindle 4 and having an inclined surface. In the rearward position, the hammer is in a rotary mode and rotation of the intermediate shaft 6 is transmitted to the spindle 4, provided the torque transmitted is below a threshold torque of the overload clutch, the operation of which will be described in greater detail below.

The slider sleeve 41 can also be moved into a forward position against the biasing force of the spring 56 via a mode change mechanism. In the forward position, the spindle drive gear 40 is moved on the slider sleeve 41 forwardly out of engagement with the intermediate shaft pinion 38 and into engagement with a spindle lock arrangement 60, the function of which is not relevant to the present invention and will therefore not be described in further detail. With the slider sleeve 41 and spindle drive gear 40 in a forward position, the hammer is in a non-rotary mode with the spindle 4 fixed against rotation. The mode change arrangement may comprise a mode change knob 55 rotatably mounted on the housing 2 and having an eccentric pin 57 which is engageable with the rearward face of the annular flange 41*a* of the slider sleeve 41 to move the slider sleeve forwardly.

In the position shown in FIG. 1, the spring 56 biases the slider sleeve 41 into its rearward position. However, on rotation of the mode change knob through 180 degrees from its position shown in FIG. 1, the eccentric pin 57 pulls the slider sleeve 41 forwardly against the biasing force of the spring 56. The eccentric pin 57 then pulls the slider sleeve 41 forwardly to move the spindle drive gear 40 out of engagement with the pinion 38 of the intermediate shaft 6 and into engagement with the spindle lock arrangement 60.

Figure 2:
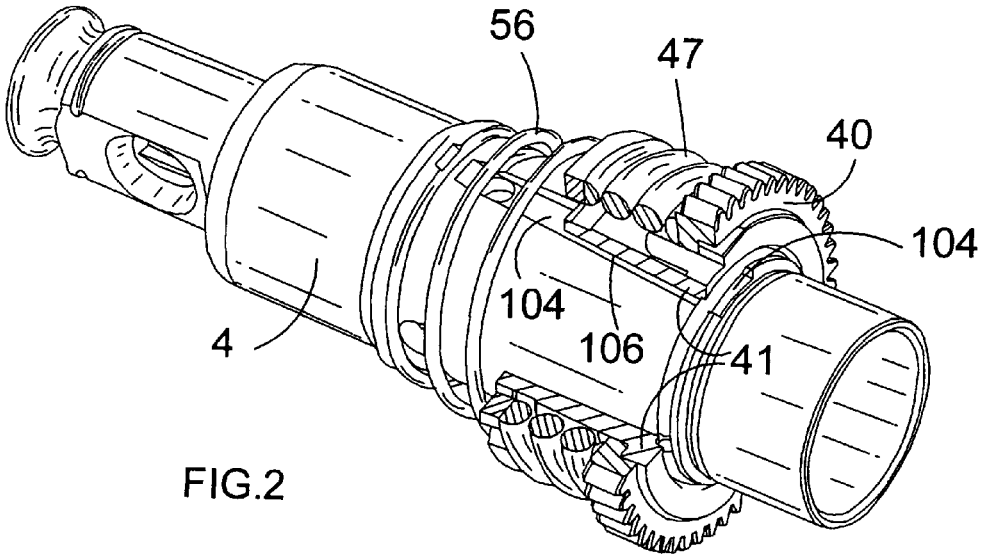
FIG. 2 is a partially cut away perspective view of a spindle and overload clutch mechanism of the hammer of FIG. 1.
Figure 3:
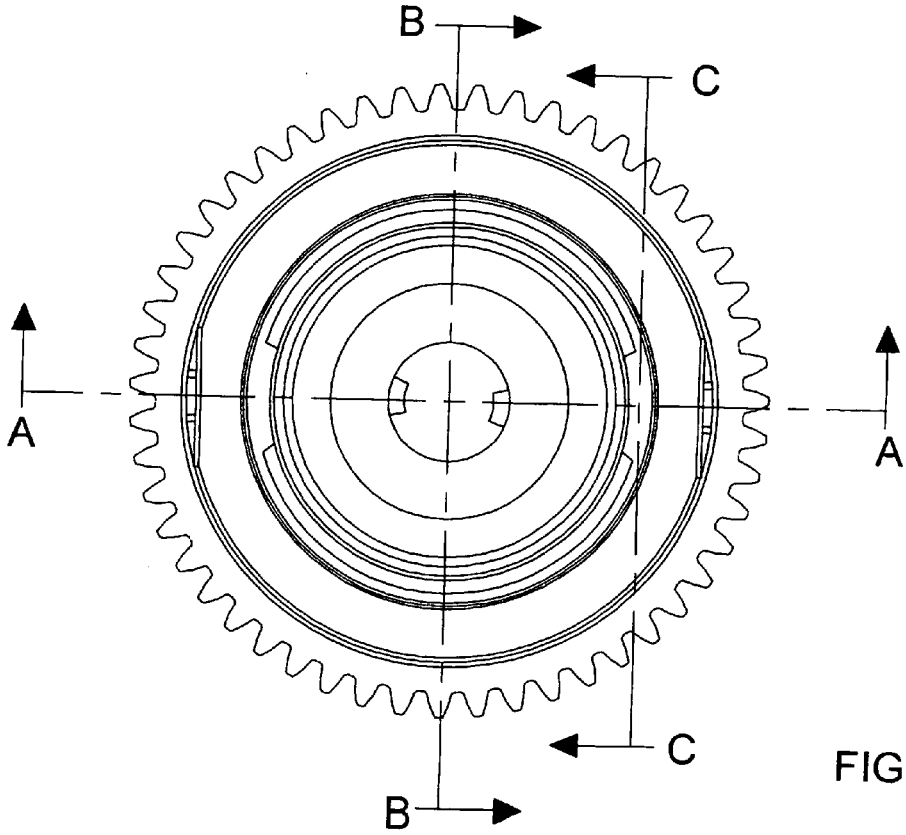
FIG. 3 is a rear end view of the mechanism of FIG. 2.
Figure 4:
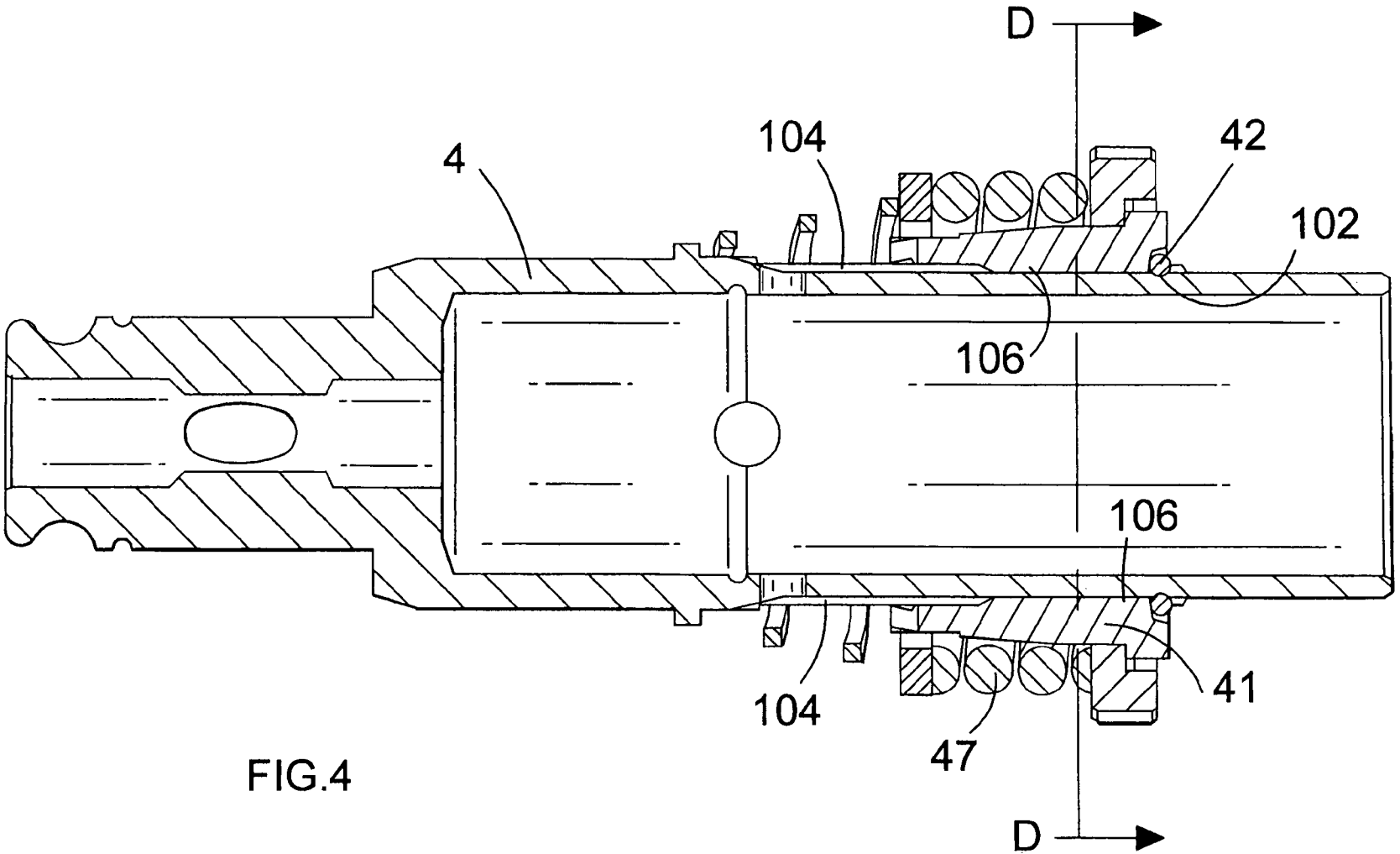
FIG. 4 is a sectional view along the line A—A in FIG. 3.
Figure 5:
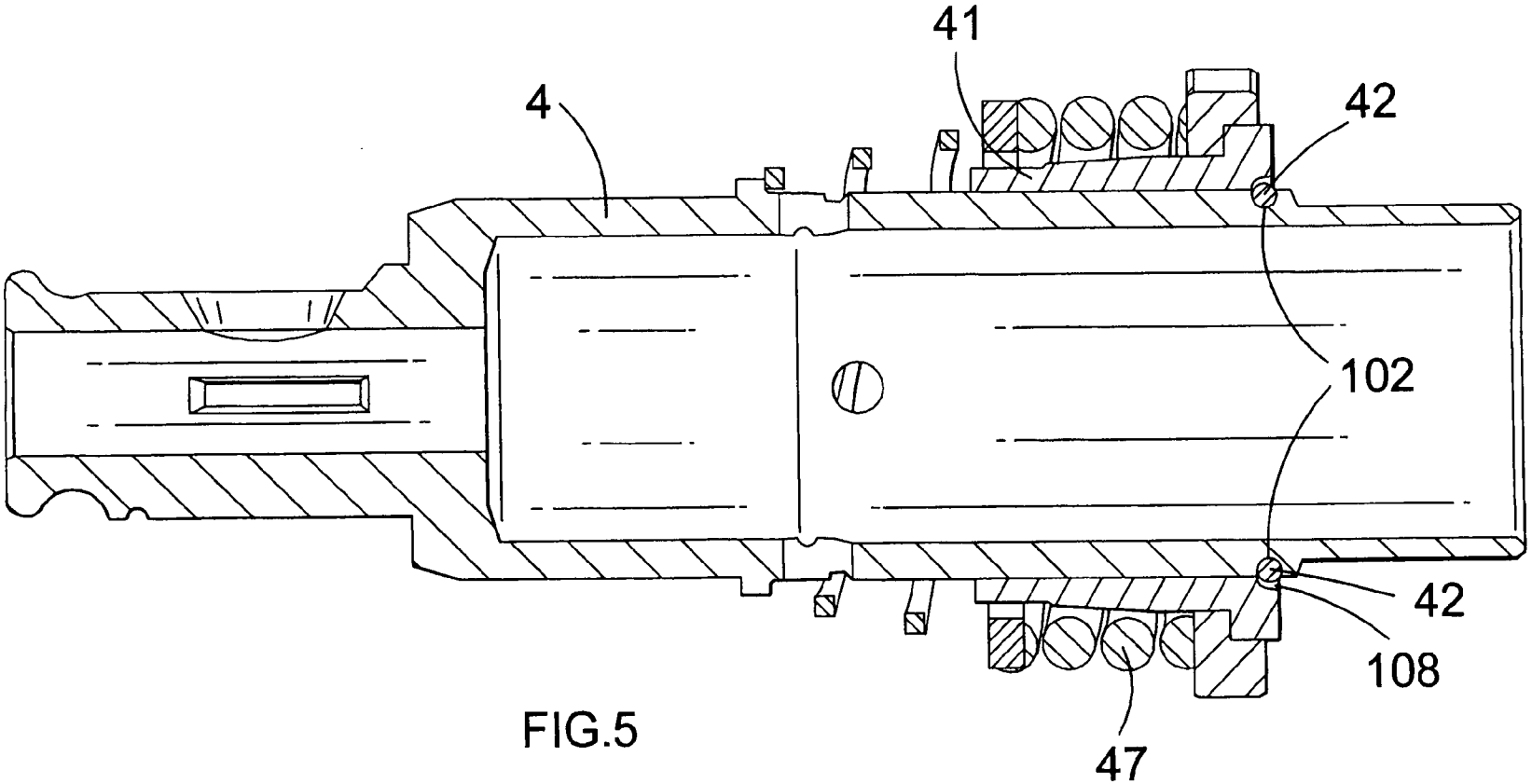
FIG. 5 is a sectional view along the line B—B in FIG. 3.
Figure 6:
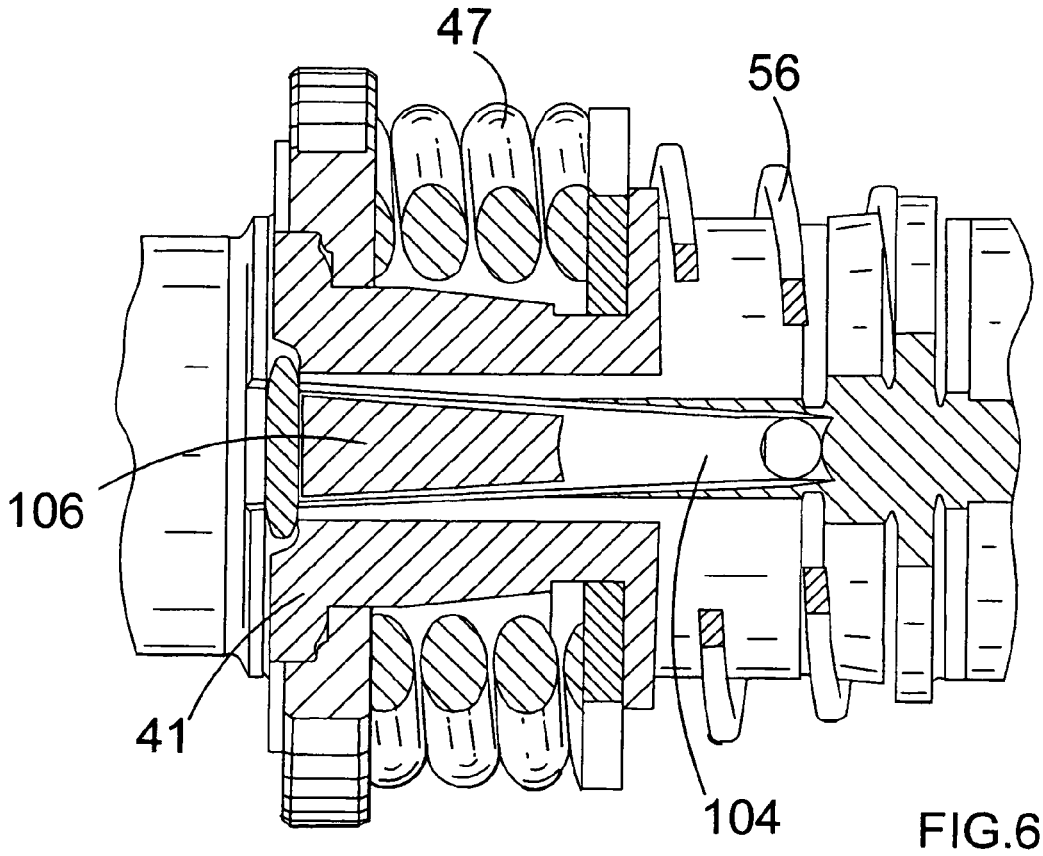
FIG. 6 is a sectional view along the line C—C in FIG. 3.
Figure 7:
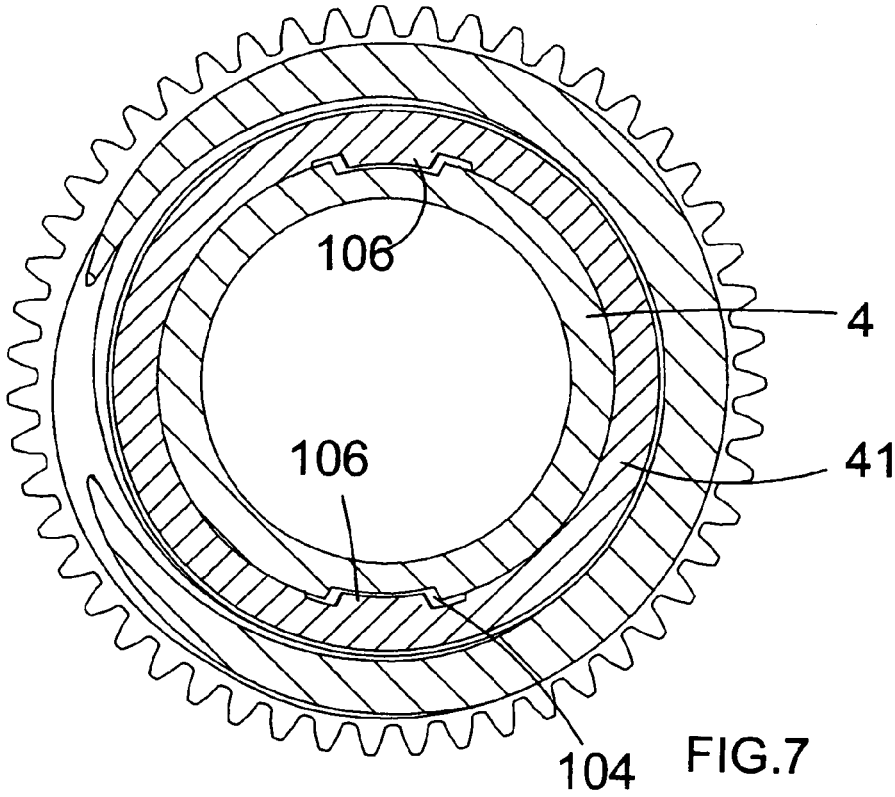
FIG. 7 is a sectional view along the line D—D in FIG. 4.
Figure 8:
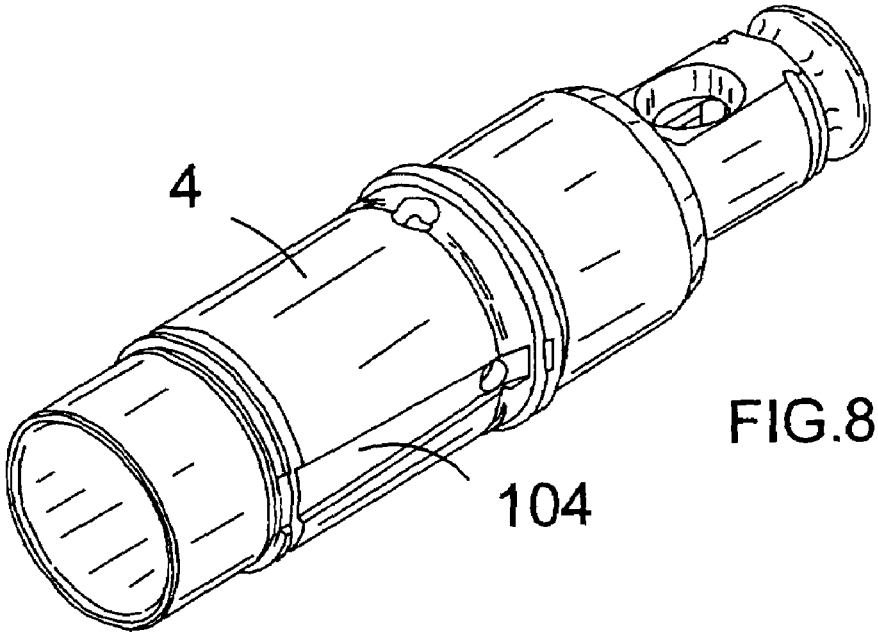
FIG. 8 is a perspective view of the spindle shown in FIG. 2 with the overload clutch mechanism removed.
Figure 9:
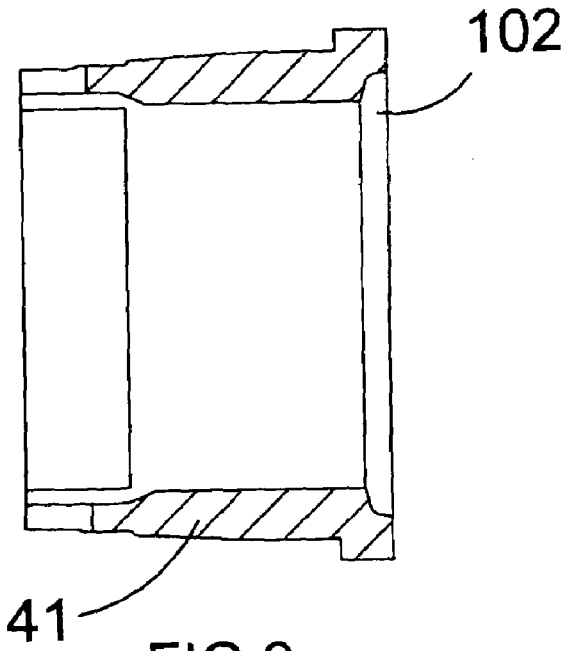
FIG. 9 is a cross-sectional elevation view of the rotary hub shown in FIG. 2.

Referring now to FIGS. 2 and 8, the external surface of the spindle 4 is formed with a series of tapering grooves 104 which become narrower in a direction moving towards the forward end of the spindle 4. The slider sleeve 41 is provided with splines 106 which also taper in a direction towards the forward end of the slider sleeve 41. In this way, the slider sleeve 41 is prevented from rotating relative to the spindle 4, but can slide axially to a limited extent relative thereto. Referring to FIGS. 4 and 5, the rearward end of the slider sleeve 41 is provided with a recess 108 having an inclined internal surface for accommodating elastomeric O-ring 42.

The operation of the rotary hammer will now be described.

When the torque required to rotationally drive the spindle 4 is below a predetermined threshold, the spring 56 biases the slider sleeve 41 into engagement with elastomeric O-ring 42, and the spring 47 biases the sets of cooperating teeth on the spindle drive gear 40 and slider sleeve 41 into engagement with each other. With these sets of cooperating teeth engaged, rotation of the intermediate shaft 6 rotationally drives the spindle drive gear 40 via pinion 38, and the spindle drive gear 40 rotationally drives the slider sleeve 41 via the interlocking facing teeth. As a result, the slider sleeve 41 rotationally drives the spindle 4 by means of cooperation between the splines 106 on the slider sleeve 41 and the grooves 104 on the spindle 4.

When the torque required to rotationally drive the spindle 4 exceeds the predetermined torque threshold, however, the inclined surfaces of the mutually engaging teeth on the spindle drive gear 40 and slider sleeve 41 slide over each other, as a result of which the drive gear 40 slides forwardly along the slider sleeve 41 against the action of spring 47. This may occur, for example, as a consequence of the hammer bit becoming stuck in a hard workpiece such as concrete. As a result, the spindle drive gear 40 can rotate relative to the slider sleeve 41 and the cooperating sets of teeth ratchet over each other, preventing the rotary drive from the spindle drive gear 40 being transmitted to the spindle 4. Furthermore, the ratcheting of the sets of teeth makes a noise which alerts the user of the hammer to the fact that the overload clutch arrangement is slipping.

In the event of a very rapid increase in the torque applied to the clutch, for example as a result of the hammer bit (not shown) becoming stuck in a workpiece such as concrete, the slider sleeve 41 may also be moved forward rapidly against the action of spring 56, and one of the side surfaces of each spline 106 comes into contact with the facing surface of the groove 104 in the spindle 4. As a result, the splines and grooves abut each other at a sliding surface angled relative to the axis of rotation of the spindle 4, which abutment between the splines 106 and grooves 104 produces a reaction force having a component parallel to the axis of rotation of the spindle 4, tending to slow down movement of the slider sleeve 41 relative to the spindle 4. It has been found that this significantly reduces problems caused by rapid forward movement of the slider sleeve 41 relative to the sleeve.

As the slider sleeve 41 is urged backwards towards O-ring 42 under the action of spring 56, as the inclined surface of recess 108 in the rear face of slider sleeve 41 comes into contact with the O-ring 42, and the slider sleeve 41 returns to its rest position more uniformly and with less impact than in the case of a solid ring such as a circlip replacing the O-ring 42.

It will be appreciated by persons skilled in the art that the above embodiment has been described by way of example only and not in any limitative sense, and that various alterations and modifications are possible without departure from the scope of the invention as defined by the appended claims. For example, although the embodiment described in detail above is a torque overload clutch, it will be appreciated by persons skilled in the art that clutches of a different type may also be within the scope of the present invention.

The invention claimed is:

1. A clutch for a rotary power tool having a housing, a spindle rotatably mounted within the housing, and a motor for causing rotation of said spindle about a first axis, the clutch comprising:

a first clutch member adapted to be mounted to said spindle and to rotate therewith and slide relative thereto in a direction substantially parallel to said first axis, said first clutch member having at least one first friction surface inclined in use relative to said first axis for engaging a respective corresponding second friction surface on said spindle as a result of movement of said first clutch member relative to the spindle;

first biasing means adapted to act between said spindle and said first clutch member for biasing said first clutch member towards a stop;

a second clutch member having a first condition in which said second clutch member engages said first clutch member and rotates therewith, and a second condition in which said second clutch member can move relative to said first clutch member; and second biasing means adapted to act between said first and second clutch members for urging said second clutch member towards said first condition.

2. A clutch according to claim 1, wherein said second clutch member is adapted to be mounted to said first clutch member and to slide relative thereto in a direction substantially parallel to said first axis, said first and second clutch members have cooperating engaging portions, and said second biasing means is adapted to urge said cooperating engaging portions into engagement with each other, such that when a torque applied between said first and second clutch members does not exceed a predetermined value, said cooperating engaging portions engage each other to prevent relative rotation between said first and second clutch members, and when said torque exceeds said predetermined value, axial movement of said second clutch member relative to said first clutch member against the action of said second biasing means occurs to disengage said cooperating engaging portions from each other, thereby pennitting relative rotation between said first and second clutch members.

3. A clutch according to claim 2, wherein the first clutch member is adapted to abut the second clutch member, and the cooperating engaging portions comprise a plurality of teeth on said first and second clutch members.

4. A clutch according to claim 3, wherein the teeth are adapted to engage each other by means of cooperating inclined surfaces.

5. A clutch according to any claim 2, wherein the cooperating engaging portions may comprise at least one third friction surface on said first clutch member and at least one fourth friction surface on said second clutch member.

6. A clutch according to claim 1, wherein the first clutch member is a drive gear adapted to be driven by means of the motor.

7. A clutch according to claim 1, wherein the first and/or second biasing means comprise at least one respective compression spring.

8. A clutch according to claim 1, further comprising at least one resilient stop member adapted to engage said first clutch member at said stop.

9. A clutch according to claim 8, wherein said first clutch member further comprises a recess having an inclined surface for engaging at least one said resilient stop member.

10. A clutch according to claim 1, wherein the first clutch member has a pair of said first friction surfaces, each said first friction surface inclined in use relative to said first axis for engaging a respective corresponding second friction surface on the spindle.

11. A clutch for a rotary power tool having a housing, a spindle rotatably mounted within the housing, and a motor for causing rotation of the spindle about a first axis, the clutch comprising:

a first clutch member adapted to be mounted to the spindle and to rotate therewith and slide relative thereto in a direction substantially parallel to said first axis;

first biasing means adapted to act between said spindle and said first clutch member for biasing said first clutch member towards a stop;

a second clutch member having a first condition in which said second clutch member engages said first clutch member and rotates therewith, and a second condition in which said second clutch member can move relative to said first clutch member;

second biasing means adapted to act between said first and second clutch members for urging said second clutch member towards said first condition; and at least one resilient stop member adapted to engage said first clutch member at said stop.

12. A clutch according to claim 11, wherein said second clutch member is adapted to be mounted to said first clutch member and to slide relative thereto in a direction substantially parallel to said first axis, said first and second clutch members have cooperating engaging portions, and said second biasing means is adapted to urge said cooperating engaging portions into engagement with each other, such that when a torque applied between said first and second clutch members does not exceed a predetermined value, said cooperating engaging portions engage each other to prevent relative rotation between said first and second clutch members, and when said torque exceeds said predetermined value, axial movement of said second clutch member relative to said first clutch member against the action of said second biasing means occurs to disengage said cooperating engaging portions from each other, thereby permitting relative rotation between said first and second clutch members.

13. A clutch according to claim 12, wherein the first clutch member is adapted to abut the second clutch member, and the cooperating engaging portions comprise a plurality of teeth on said first and second clutch members.

14. A clutch according to claim 13, wherein the teeth are adapted to engage each other by means of cooperating inclined surfaces.

15. A clutch according to claim 12, wherein the cooperating engaging portions comprise at least one first friction surface on said first clutch member and a respective second friction surface on said second clutch member.

16. A clutch according to claim 11, wherein said first clutch member further comprises a recess having an inclined surface for engaging at least one said resilient stop member.

17. A clutch according to claim 11, wherein said first clutch member further comprises at least one third friction surface inclined in use relative to said first axis for engaging a respective corresponding fourth friction surface on said spindle.

18. A clutch according to claim 17, wherein the first clutch member has a pair of said third friction surfaces, each said third friction surface inclined in use relative to said first axis for engaging a respective corresponding fourth friction surface on the spindle.

19. A clutch according to claim 11, wherein the first clutch member is a drive gear adapted to be driven by means of the motor.

20. A clutch according to claim 11, wherein the first and/or second biasing means comprise at least one respective compression spring.

21. A rotary power tool comprising:

a housing;

a spindle rotatably mounted within the housing, the spindle including a first axis and a first cooperating portion, the first cooperating portion including a first friction surface;

a motor for causing rotation of said spindle about an axis; and an overload clutch including:

a stop mounted to the spindle;

a first clutch member mounted to the spindle so as to be rotationally fixed to the spindle and axially slideable relative to the spindle, the first clutch member having a second cooperating portion engaged with the first cooperating portion, and the second cooperating portion includes a second friction surface inclined relative to the first axis, and the second friction surface engages the first friction surface when the first clutch member moves axially relative to the spindle;

a first spring located between the spindle and the first clutch member for biasing the first clutch member towards the stop;

a second clutch member mounted around the spindle and axially movable between a first position and a second position, and wherein the first position the second clutch member engages the first clutch member and rotates therewith, and wherein the first position the second clutch member is rotatable relative to the first clutch member; and a second spring located between the first clutch member and the second clutch members for biasing the second clutch member towards the first position.

22. A tool according to claim 21 wherein said first cooperating portion comprises one of a tapered projection and a tapered groove, and said second cooperating portion comprises one of a tapered groove and a tapered projection.

23. A tool according to claim 21, wherein the tool is a hammer.

24. A hammer comprising a spindle capable of being rotatingly driven by a motor via a drive chain, the drive chain comprising an overload spindle clutch which is capable of slipping when a torque which is greater than a predetermined amount is applied to it wherein the clutch comprises a sliding hub which is slidably mounted on the spindle having at least one spline formed along its inner surface which engages with a corresponding trough formed along the length of the spindle characterised in that the trough and the spline are correspondingly tapered along their length.

25. A hammer according to claim 24 wherein the end of the spline adjacent a stop mechanism, which prevents the sliding hub from travelling rearwardly more than a predetermined position due to a biasing force, has an inclined internal surface angle relative to the longitudinal axis of the sliding hub.

26. A hammer according to claim 25 wherein a rubber 0-ring is mounted adjacent the end of the spline to prevent the sliding hub from travelling rearwardly more than a predetermined position due to a biasing force.

27. A rotary power tool comprising:

a housing;

a spindle rotatably mounted within the housing, the spindle including a radially outer surface and the outer surface defining a trough having longitudinal walls that taper at a first angle along the length of the trough;

a motor for causing rotation of said spindle about an axis; and an overload clutch including:

a stop axially fixed on the spindle;

a slider sleeve mounted around the spindle, the slider sleeve including a radailly inner surface and a radailly inward spline, the spline having longitudinal walls tapering at substantially first angle and slidably engaging the walls of the trough so that the slider sleeve is connected to the spindle in a rotationally fixed and axially slideable relative arrangement;

a first spring acting between the spindle and the slider sleeve for biasing the slider sleeve towards the stop;

a drive gear rotatably mounted around the spindle and the slider sleeve and axially movable relative to the slider sleeve between a first position and a second position, and wherein the first position the drive gear driveably engages the slider sleeve and rotates therewith, and wherein the second position the second clutch member is rotatable relative to the slider sleeve; and a second spring located between slider sleeve and the drive gear for biasing the drive gear towards the first position.

28. A rotary power tool according to claim 27 wherein the slider sleeve further includes a radial flange with a first clutching surface and the drive gear includes a second clutching surface, and when the drive gear is in the first position the first clutching surface and the second clutching surface are in drivable engagement.

29. A rotary power tool according to claim 27 wherein the slider sleeve is generally cylindrical and includes a front end and rear end, and the second spring biases the drive gear rearward toward the first position.

30. A rotary power tool according to claim 27 wherein the first spring is a coil spring surrounding the spindle and located between the slider sleeve and a first spring stop axially fixed to the spindle.

31. A rotary power tool according to claim 27 wherein the second spring is a coil spring surrounding the slider sleeve and located between the drive gear and a second spring stop axially fixed to the slider sleeve.

32. A rotary power tool according to claim 27 and further comprising a drive pinion drivably engageable with the drive gear, and the slider sleeve is axially movable between a first slider sleeve position wherein the drive gear mounted around the slider sleeve is drivably engaged to the drive pinion and a second slider sleeve position wherein the drive gear is disengaged from the drive pinon.

33. A rotary power tool according to claim 32 and further comprising a mode change mechanism, and the mode change mechanism is operatively connected to the slider sleeve so that the mode change mechanism is operable to move the slider sleeve from the first slider sleeve position to the second sleeve position.

34. A rotary power tool according to claim 27 and further comprising a hammer ram, and where the spindle is a hollow spindle with the ram located inside the spindle.

* * * * *